US007172140B2

(12) United States Patent
Egler et al.

(10) Patent No.: US 7,172,140 B2
(45) Date of Patent: Feb. 6, 2007

(54) FUEL INJECTION VALVE FOR INTERNAL COMBUSTION ENGINES WITH DAMPING CHAMBER REDUCING PRESSURE OSCILLATIONS

(75) Inventors: Walter Egler, Gerlingen (DE); Peter Boehland, Marbach (DE); Sebastian Kanne, Stuttgart (DE)

(73) Assignee: Robert Bosch GmbH (DE)

( * ) Notice: Subject to any disclaimer, the term of this patent is extended or adjusted under 35 U.S.C. 154(b) by 97 days.

(21) Appl. No.: 10/312,256

(22) PCT Filed: Mar. 22, 2002

(86) PCT No.: PCT/DE02/01037

§ 371 (c)(1),
(2), (4) Date: Sep. 29, 2003

(87) PCT Pub. No.: WO02/090753

PCT Pub. Date: Nov. 14, 2002

(65) Prior Publication Data

US 2004/0061002 A1 Apr. 1, 2004

(30) Foreign Application Priority Data

May 5, 2001 (DE) ..... 101 21 891

(51) Int. Cl.
*F02M 61/20* (2006.01)

(52) U.S. Cl. ..... 239/533.9; 239/88; 239/96; 239/585.1

(58) Field of Classification Search ..... 239/533.2, 239/533.3, 533.9, 585.1, 585.3, 585.4, 88–93, 239/96; 251/129.15, 129.21, 127
See application file for complete search history.

(56) References Cited

U.S. PATENT DOCUMENTS

| | | | | |
|---|---|---|---|---|
| 5,241,935 | A | 9/1993 | Beck et al. | |
| 5,341,783 | A | 8/1994 | Beck et al. | |
| 5,467,754 | A | 11/1995 | Beck et al. | |
| 5,551,391 | A * | 9/1996 | Beck et al. | 123/305 |
| 5,551,634 | A * | 9/1996 | Raab et al. | 239/96 |
| 5,727,738 | A | 3/1998 | Hofmann et al. | |
| 5,752,659 | A * | 5/1998 | Moncelle | 239/88 |
| 6,336,595 | B1 * | 1/2002 | Barbier | 239/88 |

FOREIGN PATENT DOCUMENTS

| | | |
|---|---|---|
| DE | 44 40 182 A1 | 5/1996 |
| EP | 0 135 872 A2 | 4/1985 |

* cited by examiner

*Primary Examiner*—Steven J. Ganey
(74) *Attorney, Agent, or Firm*—Ronald E. Greigg

(57) ABSTRACT

A fuel injection valve for internal combustion engines, having a housing (12; 48) in which a pistonlike valve member (35; 60) is disposed longitudinally displaceably in a bore (34; 57). The valve member (35; 60) is surrounded, over at least part of its length, by a pressure chamber (37; 68), embodied in the housing (12; 48), that can be filled with fuel at high pressure; the valve member (35; 60) controls the communication of the pressure chamber (37; 68) with at least one injection opening (39; 66). The pressure chamber (37; 68) communicates with a damping chamber (46; 80), embodied in the housing (12; 48), via at least one throttle (44; 78) disposed in the housing (12; 48), so that pressure fluctuations that occur in the damping chamber (46; 60) rapidly fade (FIG. 1).

5 Claims, 2 Drawing Sheets

FUEL INJECTION VALVE FOR INTERNAL COMBUSTION ENGINES WITH DAMPING CHAMBER REDUCING PRESSURE OSCILLATIONS

CROSS-REFERENCE TO RELATED APPLICATIONS

This application is a 35 USC 371 application of PCT/DE 02/01037 filed on Mar. 22, 2002.

BACKGROUND OF THE INVENTION

1. Field of the Invention

The invention is directed to an improved fuel injection valve for internal combustion engines.

2. Description of the Prior Art

Various versions of fuel injection valves of the type with which this invention is concerned are known from the prior art. For instance, in German Patent Disclosure DE 196 50 865 A1, a fuel injection valve is described that is in constant communication with a common rail in which fuel at high pressure is furnished. The fuel injection valve has a housing in which a valve member is disposed longitudinally displaceably in a bore; by its longitudinal motion, this valve member controls the opening of at least one injection opening, through which fuel from a pressure chamber surrounding the valve member is injected into the combustion chamber of the engine. Because of the very fast closing events of the valve member, which are completed within a range of only a few milliseconds, pressure fluctuations occur in the pressure chamber both upon opening and upon closure of the fuel injection valve and lead on the one hand to severe mechanical stresses on the housing and on the other to an indefinite pressure state at the injection openings at the beginning of the next injection, so that the following injection begins at a state that is not precisely defined, making accurate metering and an accurate instant of injection impossible. Especially in injection events that are broken down into a preinjection, main injection and/or postinjection, this is a problem, since modern fuel injection systems react very sensitively to fluctuations in quantity upon injection.

Also known from the prior art are fuel injection valves of the kind shown for instance in German Patent Disclosure DE 196 18 650 A1. In such a fuel injection valve, there is also a housing, in which a pistonlike valve member is disposed longitudinally displaceably with a bore; with its end toward the combustion chamber, this valve member controls the opening of at least one injection opening. The valve member is again surrounded by a pressure chamber, which by the longitudinal motion of the valve member can be made to communicate with the injection openings. Via an inlet conduit extending in the housing, the pressure chamber communicates with a high-pressure fuel source, by which fuel at high pressure can be delivered to the pressure chamber. The valve member is urged in the closing direction with a closing force by a mechanical device in the housing of the fuel injection valve, preferably by a helical compression spring, so that in the absence of a corresponding hydraulic opposing force, it remains in the closing position and thus closes the injection openings. In this fuel injection valve as well, especially at the onset and end of the injection event, pressure fluctuations occur in the region of the pressure chamber, where they can lead to mechanical stresses, and if the fluctuations persist can lead to an undefined state at the onset of the next injection and can impair the quality of subsequent injections.

SUMMARY OF THE INVENTION

The fuel injection valve of the present invention has the advantage over the prior art that accurately defined injection events in rapid succession are made possible. Pressure fluctuations that occur in the region of the pressure chamber and hence in the immediate vicinity of the injection openings are damped, so that very quickly after the closing event of the fuel injection valve, a static state is again achieved in the pressure chamber. To that end, the pressure chamber communicates with a damping chamber, embodied in the housing, via at least one throttle disposed in the housing. If pressure changes occur in the region of the pressure chamber, of the kind caused for instance by the opening or closure of the valve member, then a higher or lower fuel pressure than in the damping chamber prevails in the pressure chamber. Because of this pressure drop, fuel will flow through the throttle, either from the pressure chamber into the damping chamber or from the damping chamber into the pressure chamber and will thus bring about a pressure equalization between the damping chamber and the pressure chamber. Since the fuel flowing back and forth has to pass through the throttle, these pressure fluctuations are damped by friction losses at the throttle, so that fading of these pressure fluctuations is very rapid, and a static pressure level in the pressure chamber is rapidly achieved.

In an advantageous embodiment of the subject of the invention, the damping chamber is embodied as a blind bore embodied in the housing of the fuel injection valve. The blind bore discharges directly into the pressure chamber here, and the throttle is preferably located close to the pressure chamber. Because the damping chamber is embodied as a blind bore, the damping chamber in the housing can be produced simply and economically.

In a further advantageous feature, more than one throttle is disposed in the throttle and forms the communication passage between the damping chamber and the pressure chamber. As a result, the damping action of the throttles can be boosted, and by means of different throttles, better adaptation to the requirements of the fuel injection valve can be achieved.

In another advantageous feature of the subject of the invention, the valve member is disposed in a valve body, while the damping chamber is embodied in a valve holding body, and both the valve body and the valve holding body are part of the housing. Between the valve body and the valve holding body there is a shim, through which the communication passage from the pressure chamber to the damping chamber extends. The throttle is disposed in the shim, so that by replacing the shim with a shim that has a different sized throttle, easy replacement of the throttle and hence an adaptation of the damping action to various fuel injection valves is possible, without having to change the construction of the fuel injection valve otherwise.

DESCRIPTION OF THE DRAWINGS

Further advantages and advantageous features of the subject of the invention can be learned from the description contained herein below, taken in conjunction with the drawings, in which.

DESCRIPTION OF THE PREFERRED EMBODIMENTS

Figure 1:
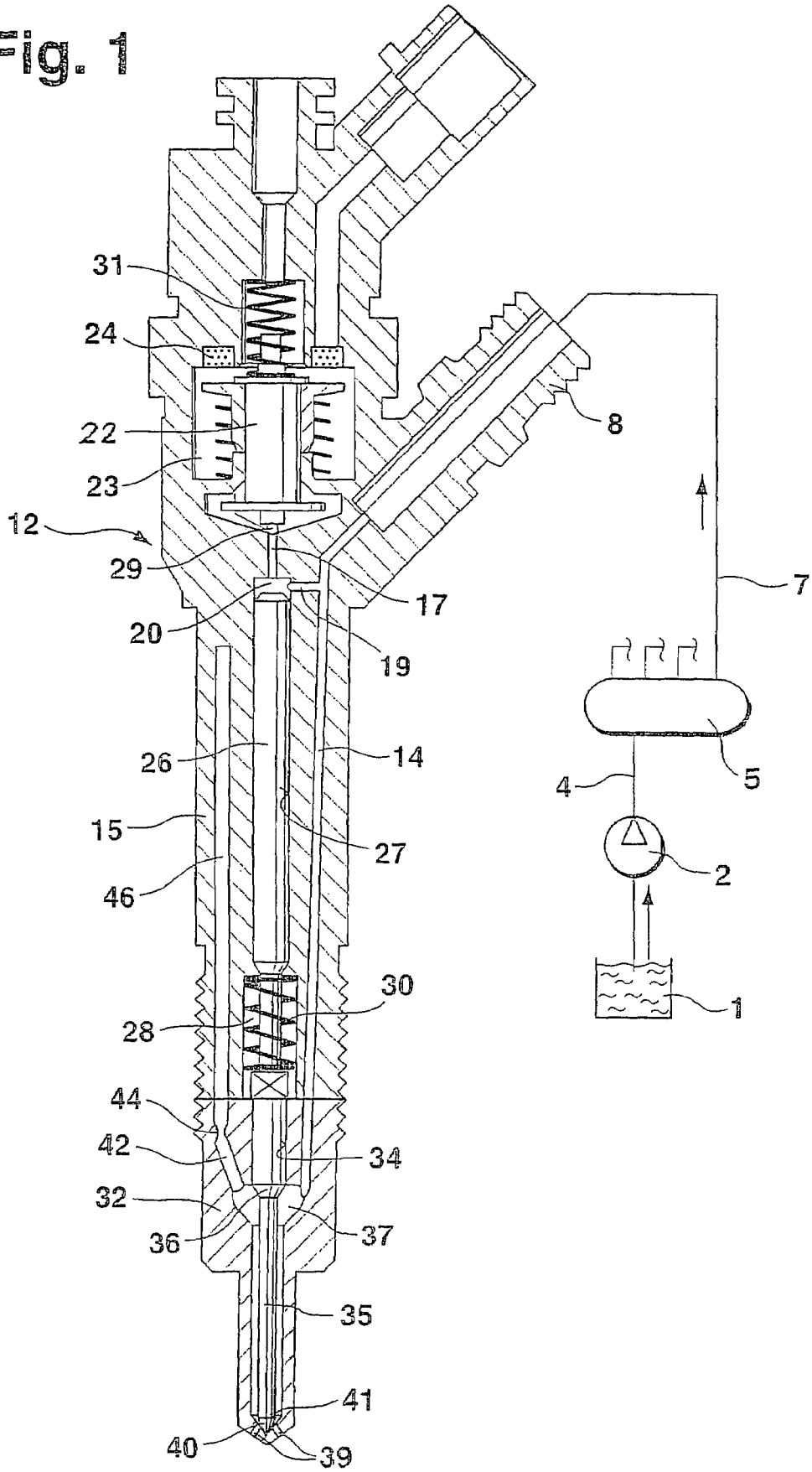
FIG. 1 shows a fuel injection valve in longitudinal section, together with the high-pressure fuel supply that is shown schematically.

In FIG. 1, a longitudinal section through a fuel injection valve of the invention is shown, along with the schematically illustrated high-pressure fuel supply. The fuel injection valve has a housing 12, which includes a valve holding body 15 and a valve body 32. A bore 34 is embodied in the valve body 32, and a pistonlike valve member 35 is disposed longitudinal displaceably in this bore. In a portion remote from the combustion chamber, the valve member 35 is guided sealingly in the bore 34, and it tapers toward the combustion chamber, forming a pressure shoulder 36. At the level of the pressure shoulder 36, a pressure chamber 37 is embodied in the valve body 32 by means of an enlargement of the bore 34; this pressure chamber continues in the form of an annular conduit, surrounding the valve member 35, as far as the end toward the combustion chamber of the bore 34. With its end toward the combustion chamber, the valve member 35 controls the opening of at least one injection opening 39, which connects the pressure chamber 37 with the combustion chamber of the engine. To that end, a valve sealing face 40 is embodied on the end of the valve member 35 toward the combustion chamber, and this valve sealing face cooperates with a valve seat 41 embodied on the end toward the combustion chamber of the bore 34. Via an inlet conduit 14 embodied in the housing 12, the pressure chamber 37 communicates with a high-pressure connection 8. The high-pressure connection 8 communicates via a high-pressure line 7 with a common rail 5, in which fuel is present at a predetermined high pressure; the fuel is delivered to the common rail 5 from a fuel tank 1 via a high-pressure pump 2 and a fuel line 4.

On the side of the valve member 35 remote from the combustion chamber, a spring chamber 28 is embodied in the valve holding body, and a helical compression spring 30 is disposed in it. The helical compression spring 30 is prestressed in compression and with its end toward the valve member 35, it urges the valve member 35 in the closing direction. Coaxially to the bore 34 and on the side of the spring chamber 28 remote from the combustion chamber, a piston bore 27 is embodied in the valve holding body 15; it discharges into the spring chamber 28, and a piston rod 26 is disposed in it that rests with its end toward the combustion chamber on the valve member 35 and with its face end remote from the combustion chamber defines a control chamber 20. The control chamber 20 communicates here with the inlet conduit 14 via an inlet throttle 19 and with a leak fuel chamber 23, embodied in the valve holding body 15, via an outlet throttle 17; the leak fuel chamber communicates with a leak fuel system, not shown in the drawing, and thus always has a low pressure. A magnet armature 22 is disposed in the leak fuel chamber 23; it is urged in the direction of the control chamber 20 by a closing spring 31, and a sealing ball 29 that closes the outlet throttle 17 is secured to it. Also disposed in the leak fuel chamber 23 is an electromagnet 24, which given a suitable supply of current exerts an attracting force on the magnet armature 22, counter to the force of the closing spring 31, and moves the magnet armature away from the control chamber 20, and as a result the control chamber 20 communicates with the leak fuel chamber 23. If the electromagnet 24 is switched to be currentless, then the magnet armature 22, by the force of the closing spring 31, moves in the direction of the control chamber 20 again and with the sealing ball 29 closes the outlet throttle 17.

In the valve holding body 15, there is a damping chamber 46, which is embodied as a blind bore and whose open end is disposed on the face end, toward the valve body 32, of the valve holding body 15. The blind bore forming the damping chamber 46 extends parallel here to the piston bore 27 and communicates with the pressure chamber 37 via a communication passage 42 embodied in the valve body 32. A throttle 44, which is embodied by a cross-sectional constriction of the communication passage 42, is disposed in the communication passage 42. If a pressure difference prevails between the pressure chamber 37 and the damping chamber 46, then fuel can flow from one chamber to the other via the communication passage 42 and the throttle 44 and thus lead to a pressure equalization.

The mode of operation of the fuel injection valve is as follows: Because of the communication of the pressure chamber 37 with the common rail 5 via the inlet conduit 14 and the high-pressure line 7, a high fuel pressure, of the kind also kept on hand in the common rail 5, always prevails in the pressure chamber 37. If an injection is to be effected, the electromagnet 24 is actuated, and the magnet armature 22 uncovers the outlet throttle 17, as described above. As a result, the fuel pressure in the control chamber 20 drops, and the hydraulic force on the face end, remote from the combustion chamber, of the piston rod 26 is reduced, so that the hydraulic force on the pressure shoulder 36 predominates, and the valve member 35 is moved in the opening direction, as a result of which the injection openings 29 are uncovered. To terminate the injection, the current to the electromagnet 24 is changed accordingly, and with the sealing ball 29, the magnet armature 22, driven by the closing spring 31, again closes the outlet throttle 17. By means of the replenishing fuel flowing through the inlet throttle 19, the high fuel pressure of the kind also prevailing in the inlet conduit 14 builds up again in the control chamber 20, and so the hydraulic force on the piston rod 26 becomes greater than the hydraulic force on the pressure shoulder 36, and the valve member 35 moves back into the closing position. As a result of the closing event, the fuel, which flows in the pressure chamber 37 in the direction of the injection openings 29 during the injection, is abruptly braked, so that the energy of motion of the fuel is converted into compression work. This creates a pressure wave, which is propagated in the pressure chamber 37. The increase in pressure thus caused leads to a pressure difference between the pressure chamber 37 and the damping chamber 46, where at least approximately the pressure that was also present in the pressure chamber 37 before the onset of the injection still prevails. As a result of this pressure difference, some fuel flows out of the pressure chamber 37, through the communication passage 42 and the throttle 44, into the damping chamber 46 and from there, depending on the pressure difference between the damping chamber 46 and the pressure chamber 37, flows back again into the pressure chamber 37. On passing through the throttle 44, friction work must be performed, which rapidly damps these pressure fluctuations, so that after only a short time a static pressure level is again reached in the pressure chamber 37. For the next injection, a defined pressure state thus prevails in the pressure chamber 37, which enables a correspondingly accurate and precise injection.

Figure 2:
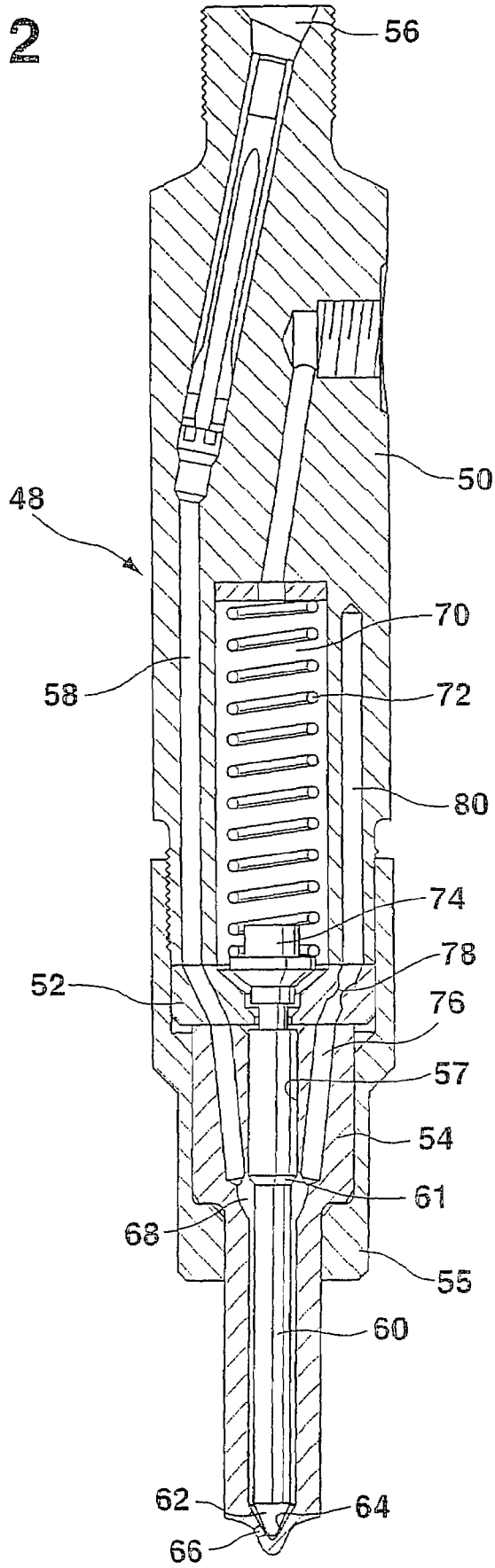
FIG. 2 is a longitudinal section through a further fuel injection valve of the invention.

In FIG. 2, a further exemplary embodiment of the fuel injection valve of the invention is shown in longitudinal section. In this fuel injection valve, the damping of the pressure fluctuations is done in the same way as in the fuel injection valve shown in FIG. 1, but the other components and the mode of operation are different. A valve holding body 50 is braced against a valve body 54 by means of a lock nut 55, with the interposition of a shim 52. A bore 57 is embodied in the valve body 54, and a valve member 60, which is embodied in pistonlike fashion, is disposed longitudinally displaceably in this bore. The valve member 60, on its end toward the combustion chamber, has a sealing face 62, which cooperates with a valve seat 64 embodied on the end of the bore 57 toward the combustion chamber and thus controls the opening of at least one injection opening 66 disposed in the valve seat 64. By means of a taper of the valve member 60 toward the combustion chamber, a pressure shoulder 61 is embodied on the valve member 60, at the level of which shoulder a pressure chamber 68 is embodied by means of a cross-sectional widening of the bore 57; via an inlet conduit 58 embodied in the valve body 54 of the shim 52 and in the valve holding body 50, this pressure chamber communicates with a high-pressure connection 56. The high-pressure connection 56 communicates with a high-pressure fuel source, not shown in the drawing, which is capable of delivering fuel at high pressure to the high-pressure connection 56 and, through the inlet conduit 58, to the pressure chamber 68.

Remote from the combustion chamber, the valve member 60 changes over to a spring plate 74, which is disposed in an opening in the shim 52 and protrudes as far as the inside of a spring chamber 70 embodied in the valve holding body 50. Between the spring plate 74 and the end of the spring chamber 70 remote from the combustion chamber, there is a closing spring 72, which is embodied as a helical compression spring and has a pressure prestressing, so that a closing force is exerted on the valve member 60. A communication passage 76 discharges into the pressure chamber 68 and communicates, via a throttle 78 embodied in the shim 52, with a damping chamber 80 embodied in the valve holding body 50. The throttle 78 is embodied by means of a cross-sectional constriction of the communication passage 76, but it is also possible for more than one throttle 78 to be disposed in the shim 52. As in the exemplary embodiment already shown in FIG. 1, the damping chamber 78 is embodied as a blind bore, which extends parallel to the longitudinal axis of the spring chamber 70 or of the bore 57. The length of the blind bore and thus the volume of the damping chamber 80 can be varied, depending on the damping action desired. If an injection is to be effected, fuel is introduced into the high-pressure connection 56, so that the fuel flows through the inlet conduit 58 into the pressure chamber 68. If the hydraulic force on the pressure shoulder 61 exerted by the fuel pressure in the pressure chamber 68 exceeds the closing force of the closing spring 72, then the valve member 60 moves away from the valve seat 64 and uncovers the injection openings 66. If the fuel delivery to the pressure chamber 68 is interrupted, then the fuel pressure there drops; when a certain pressure in the pressure chamber 68 fails to be attained, the force of the closing spring 72 prevails over the hydraulic force on the valve member 60, whereupon the valve member returns to its closing position. The closure of the fuel injection valve creates pressure fluctuations in the pressure chamber 68, in the manner already described above. They lead to a fuel flow between the pressure chamber 68 and the damping chamber 80 via the throttle 78, so that the pressure fluctuations are rapidly damped by this process. The embodiment of the throttle 78 in the shim 52 is especially advantageous here, because by replacing the shim 52, a different throttle 78 can be installed in the communication passage between the pressure chamber 68 and the damping chamber 80, without requiring other structural changes to the fuel injection valve. Alternatively, it can be provided that the throttle 78 is still disposed inside the valve body 54, for instance directly at the pressure chamber 68.

As an alternative to the exemplary embodiments shown in FIGS. 1 and 2, it can also be provided that the damping chamber 46 in FIG. 1 or the damping chamber 80 in FIG. 2 not be embodied as a blind bore but instead as a hollow chamber in the housing of the fuel injection valve that can assume any arbitrary shape. Thus the three-dimensional possibilities of the fuel injection valve can be optimally utilized without having to make structural changes in the existing functional components. Moreover, it can be provided that more than one throttle 44; 78 be disposed in the communication passage between the pressure chamber 37; 68 and the damping chamber 46; 80. As a result, an optimal damping performance of the throttle 44; 78 can be achieved.

The foregoing relates to preferred exemplary embodiments in the invention, it being understood that other variants and embodiments thereof are possible within the spirit and scope of the invention, the latter being defined by the appended claims.

We claim:

1. A fuel injection valve of internal combustion engines, comprising a housing (12; 48) having a bore (34; 57) formed therein, a pistonlike valve member (35; 60) disposed longitudinally displaceably in the bore (34; 57), a pressure chamber (37; 68) embodied in the housing (12; 48) that can be filled with fuel at high pressure via an inlet conduit (14, 58), the valve member (35; 60) being surrounded over at least part of its length by the pressure chamber (37; 68), the valve member (35; 60) controlling the communication of the pressure chamber (37; 68) with at least one injection opening (39; 66), and a damping chamber (46; 80), embodied in the housing (12; 48), the pressure chamber (37; 68) communicating with the damping chamber (46; 80) via a communication passage (42, 76) and at least one throttle (44; 78) disposed in between the communication passage (42, 76) and the damping chamber, wherein the throttle (44; 78) is embodied by a cross-sectional constriction between the communication passage and the damping chamber (46; 80).

2. The fuel injection valve of claim 1, wherein the housing (48) comprises a valve body (54) and a valve holding body (50), the valve member (60) being disposed in the valve body (54), which is braced against the valve holding body (50) with the interposition of a shim (52); and wherein the damping chamber (80) is embodied in the valve holding body (50), which communicates with the pressure chamber (68) through a communication passage embodied in the shim (52) and in the valve body (54), and the throttle (78) is embodied in the shim (52).

3. A fuel injection valve of internal combustion engines, comprising a housing (12; 48) having a bore (34; 57) formed therein, a pistonlike valve member (35; 60) disposed longitudinally displaceably in the bore (34; 57), a pressure chamber (37; 68) embodied in the housing (12; 48) that can be filled with fuel at high pressure, the valve member (35; 60) being surrounded over at least part of its length by the pressure chamber (37; 68), the valve member (35; 60) controlling the communication of the pressure chamber (37; 68) with at least one injection opening (39; 66), and a damping chamber (46; 80), embodied in the housing (12; 48), the pressure chamber (37; 68) communicating with the damping chamber (46; 80) via a communication passage (42, 76) and at least one throttle (44; 78) disposed in between the communication passage (42, 76) and the damping chamber, wherein the damping chamber (46; 80) is closed off, except for its communication with the pressure chamber (37; 68) and wherein the throttle (44; 78) is embodied by a cross-sectional constriction between the communication passage and the damning chamber (46; 80).

4. A fuel injection valve of internal combustion engines, comprising a housing (12; 48) having a bore (34; 57) formed therein, a pistonlike valve member (35; 60) disposed longitudinally displaceably in the bore (34; 57), a pressure chamber (37; 68) embodied in the housing (12; 48) that can be filled with fuel at high pressure, the valve member (35; 60) being surrounded over at least part of its length by the pressure chamber (37; 68), the valve member (35; 60) controlling the communication of the pressure chamber (37; 68) with at least one injection opening (39; 66), and a damping chamber (46; 80), embodied in the housing (12; 48)the pressure chamber (37; 68) communicating with the damping chamber (46; 80) via a communication passage (42, 76) and at least one throttle (44; 78) disposed in between the communication passage (42, 76) and the damping chamber, wherein the damping chamber (46; 80) is embodied by a blind bore, made in the housing (12; 48), that discharges directly into the pressure chamber (37; 68) and wherein the throttle (44; 78) is embodied by a cross-sectional constriction between the communication passage and the damping chamber (46; 80).

5. The fuel injection valve of claim 4, wherein the blind bore extends at least substantially parallel to the longitudinal axis of the valve member (35; 60).

* * * * *